US005211091A

United States Patent [19]

Cole

[11] Patent Number: 5,211,091

[45] Date of Patent: May 18, 1993

[54] PLEAT PACK CUTTER

[75] Inventor: Everett A. Cole, Fayetteville, N.C.

[73] Assignee: Purolator Products Company, Tulsa, Okla.

[21] Appl. No.: 907,874

[22] Filed: Jul. 2, 1992

[51] Int. Cl.[5] ..... B26D 5/34; B26D 5/42

[52] U.S. Cl. ..... 83/69; 83/74; 83/99; 83/176; 83/210; 83/282; 83/423; 83/949

[58] Field of Search ..... 83/69, 74, 76.8, 99, 83/169, 176, 210, 282, 423, 949; 493/22, 25, 29, 30, 342, 357, 358, 372

[56] References Cited

U.S. PATENT DOCUMENTS 2,833,351 5/1958 Paton et al. ..... 83/176
3,625,099 12/1971 Mase et al. ..... 83/949
4,262,568 4/1981 Wallis ..... 83/176

*Primary Examiner*—Hien H. Phan

*Attorney, Agent, or Firm*—Head & Johnson

[57] ABSTRACT

An apparatus for cutting pleated paper, and especially for filtration media for the automotive industry. Two tooth roller chains in parallel are supported above a support plate upon which pleated paper is placed. There is an opening in the plate through which the teeth of two sprockets supported beneath the plate may extend to mesh with the teeth of the corresponding roller chain. The teeth on both the chain and the sprocket are the same height as the pleated paper and when driven by an electric motor pulls the paper through the device separating each pleat. One pleat at a time is pushed through a slit in the table top at which point the pleat knuckle is sheared off by pneumatic operated cutter blade. A fiberoptics infrared scanner is used to monitor the amount of pleated material available. The number of pleats cut on any one run is controlled.

8 Claims, 4 Drawing Sheets

PLEAT PACK CUTTER

FIELD OF THE INVENTION

This invention relates to counting and cutting of pleated paper and more particularly, filtration media for the automobile industry.

BACKGROUND OF THE INVENTION

In the making of filters for automobiles, for example, a roll of paper is obtained and passed through a pleating machine that puts the paper into pleats much like an accordion. The pleated paper has valleys and peaks. It is common practice to cut off the tip of the valleys, or knuckles, and a selected number of cut pleats are then packed to be used as a filter. In some prior devices the pleated paper is sprayed with a dot of paint to indicate the approximate location where the pack is to be cut. The dot of paint is not precise and may be accurate within only four or five pleats. The operator then manually pushes the paper pack through the slotted table one pleat at a time and manually actuates a device to shear the knuckle, or tip of the valley, off.

SUMMARY OF THE INVENTION

This invention relates to an apparatus for shearing knuckles, or valleys, off pleated paper that is obtained from a source of pleated paper onto a table with a slit therethrough. Packs of sheared pleats are used in making filters. It is important that the correct number of pleats be in each pack. The preferred apparatus has two toothed roller chains in parallel that are supported above the plate or table and two toothed sprockets directly under the roller chains with the teeth meshing. The teeth of the sprocket extend through an opening in the table. The teeth are the same height as the pleated paper and when driven by a motor, pull the paper through the device successively separating each pleat individually. At the precise moment that the pleat is properly aligned with the slit in the table, a paper pusher pushes the pleat through the slit and a knife located below the table shears the pleat knuckle, which normally is approximately ⅛ inch. Means are provided to ensure that the pleat is in the proper position when the paper pusher is actuated. Means are also provided to count the pleats so that a selected number of pleats can be separated for an individual pack of sheared pleats.

Means are provided to monitor the amount of pleated material in the pack cutter entrance chamber. A fiber-optic infrared scanner is used to monitor the amount of light that travels across the pleated material just before the entrance to the pack cutter. This indicates how much material is available.

It is thus seen that an object of this invention is to provide a novel apparatus for pulling pleated paper through a device where the knuckles are precisely cut.

It is still a further object of this invention to provide a system for cutting knuckles off of pleated paper and to provide a selected number of pleats in a pack.

Further objects and a better understanding of the invention can be had from the following description, taken in conjunction with the attached drawings.

DESCRIPTION OF THE INVENTION

Figures 1, 2:
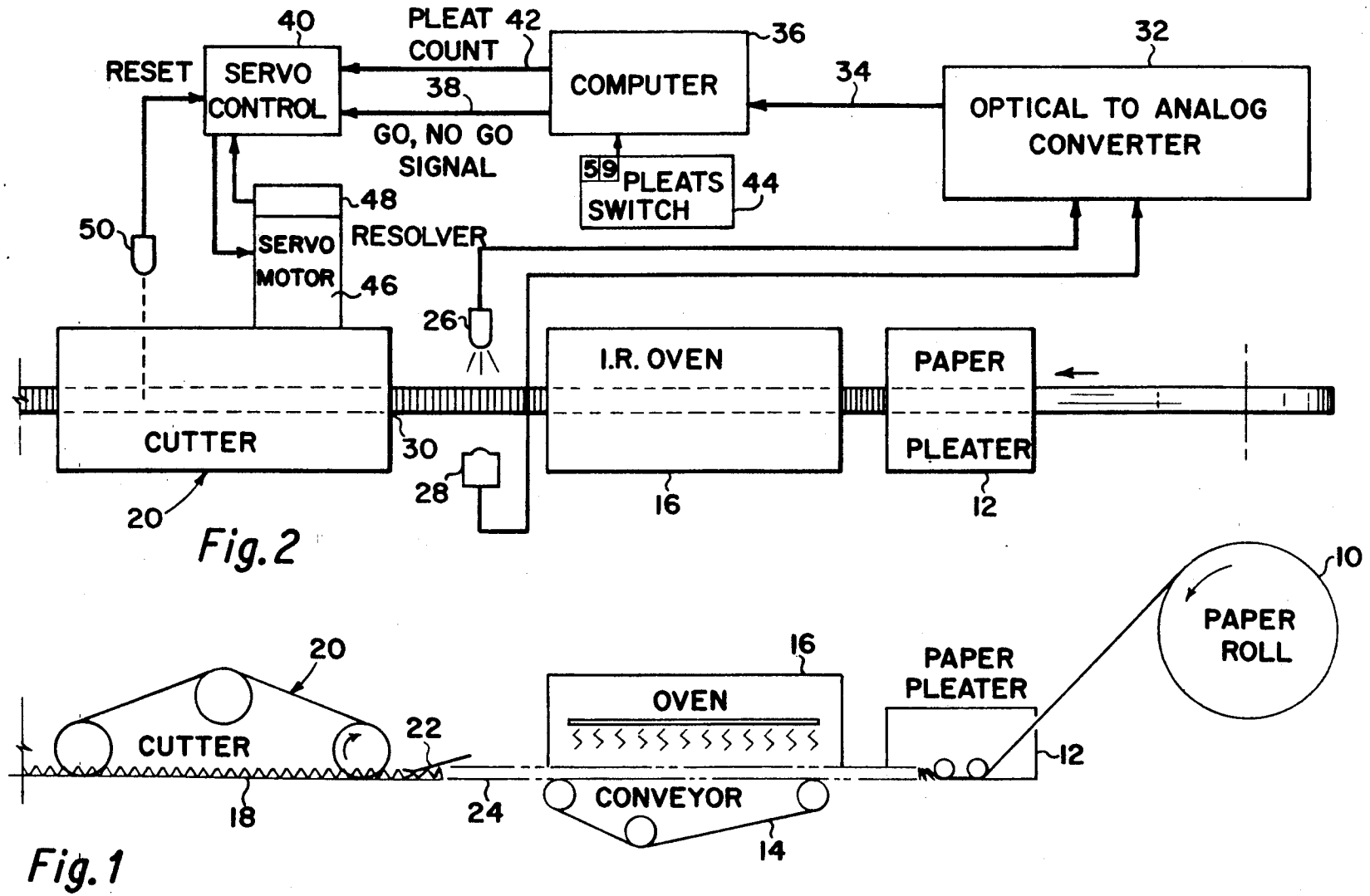
FIG. 1 is a schematic diagram showing the flow of paper through the system.
FIG. 2 is a block diagram showing in greater detail the overall concept of the invention.

Attention is first directed to FIG. 1 that shows paper being taken from large paper roll 10 and passed through paper pleater 12. The paper, after it is pleated, is conveyed by conveyor 14 to an oven 16 along table top 24. The oven, paper pleater and paper roll are conventional. A flat spring 22 holds the pleated paper 18 down where it is passed into cutter 20. Paper pleaters are well known and are used to put the pleats into the paper, such as that illustrated in FIG. 6. The pleated paper is forced onto a conveyor where oven 16 drives most of the moisture from the paper, making it slightly rigid. The cutter illustrated in FIGS. 1 and 2 will be more fully discussed in regard to the other figures, but in its broadest aspects is comprised of two toothed chains in parallel with two toothed sprockets directly under the roller chains with the teeth meshing. The teeth of both the chain and the sprockets are the same height as the pleated section of the pleated paper and when driven, pull the paper through the device separating each pleat out individually. As will be further seen in the discussion of the other figures, a push mechanism pushes one pleat at a time through a slit in the table top and shear plate insert 99 at which point the pleat knuckle is sheared off by a cutter blade.

Figure 6:
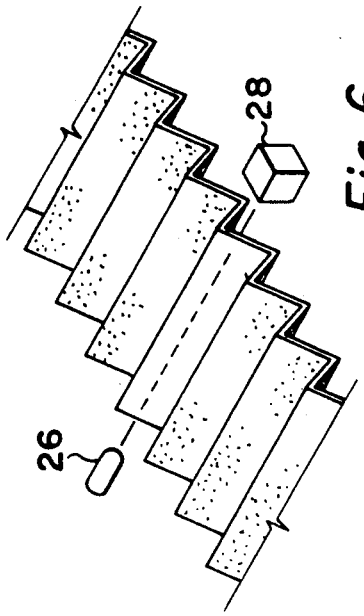
FIG. 6 illustrates the pleated paper in expanded form with an optical scanner.

Two instrumentation methods have been implemented in the controls of the pleat pack cutter. One method is for controlling the amount of pleated material in the pack cutter entrance chamber. This is illustrated in FIG. 2 as a light source 26 and a photodiode 28. This is used to monitor the amount of material in the chamber that is fed into the cutter at its entrance 30 to ensure that the right amount of pleated paper is available so that the pack cutter pulls only one pleat at any time to prevent a jammed condition. Next, one must make certain that a sufficient amount of material is present to prevent the pack cutter from stretching and changing the elasticity of the pack. As the pleated material is pulled apart by the toothed roller chains there will be an increase in light traveling across the pleated material, and if the pleated material is compressed the light that travels across the material is decreased. This amount of light is detected by an optic infrared scanner 28 as illustrated in FIG. 6. If desired the light source 26 and detector 28 could be above and below the pleated paper. The output of optic infrared scanner 28 is conveyed to optical-to-analog convertor 32 that has an output on line 34 to computer 36. If the signal from the optic infrared scanner indicates that there is the right amount of paper, then computer 36 transmits a "go" signal on line 38 to servo controller 40. Thus the cutting process starts. If there is too great of compaction of the material, then there is a "no go" signal conveyed to servo controller 40 that will shut down the servo motor so that corrective action can be taken by an operator.

Normally, the operator would wish to cut a certain number of pleats to form a pack, e.g. such as 59 pleats to make one pack, which would be processed in other filter manufacturing equipment. A pleat switch 44 can be used to enter in the desired number of pleats in that pack into computer 36. Computer 36 transmits over line 42 to servo controller 40 how many pleats are needed in the pack to be developed. A set amount of pleats in a precise length of the pack is necessary for the next piece of processing equipment to properly preform its function. The method used for cutting knuckles (or tips) off a selected number of pleats employs servo controller 40 that continually monitors the position of the shaft of the output servo motor 46. Each revolution of the output shaft generates a known number of pulses. The controller retains a total pulse count from the start of each sequence. A mathematical relationship is avialable between each servo motor position and the leading edge of each delivery tooth on the chain. This provides a means to produce a pack with a set number of pleats from the output of the pack. A resolver 48 works with servo motor 46 to convert rotation of the motor to pulses and sends them to servo controller 40. An infrared scanner 50 is used to be sure that the teeth that pull the paper are at the required precise point each time the cutter functions. If the teeth are not at the proper position at a cut, then the servo makes a correcting adjustment in rotation.

Figure 3:
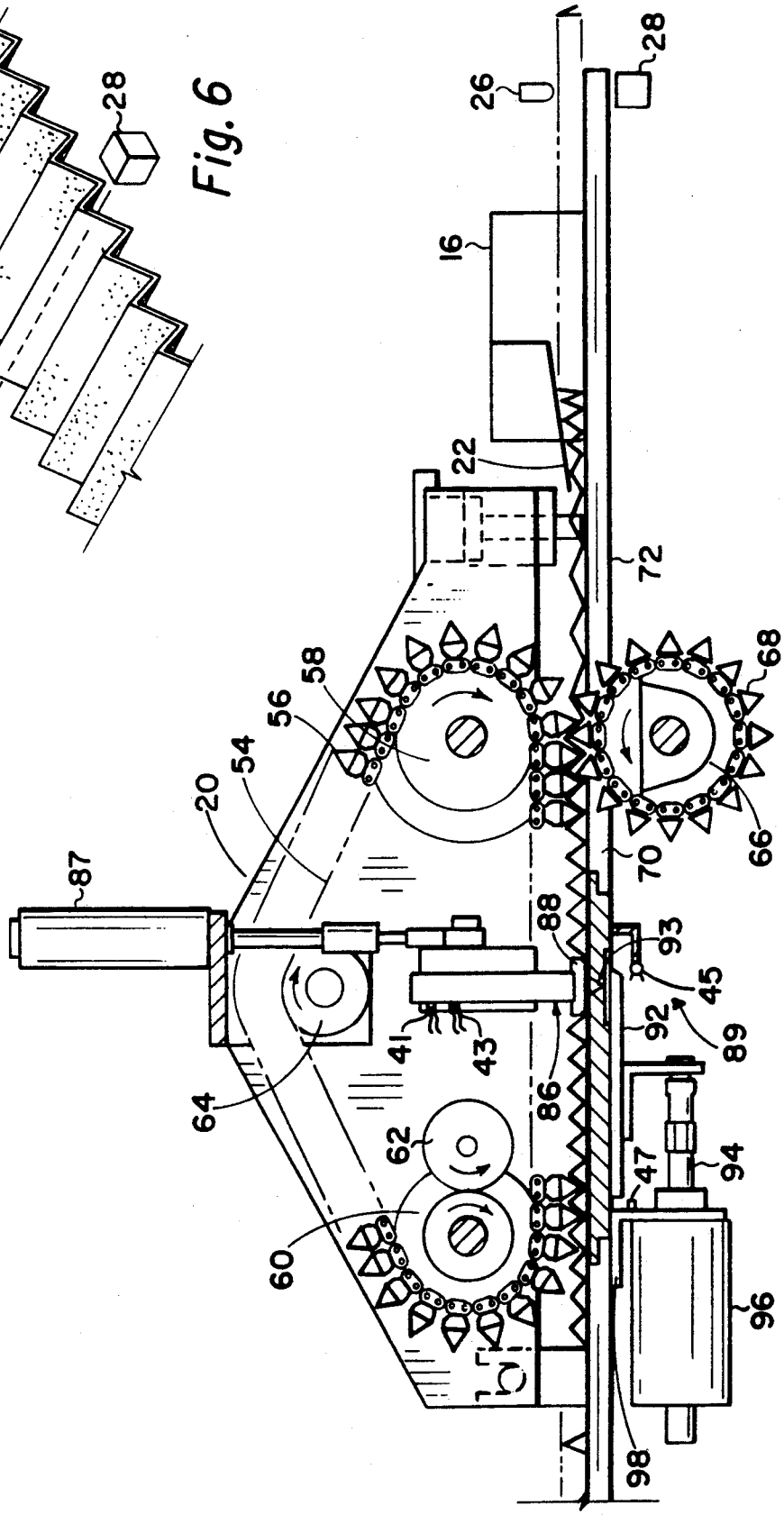
FIG. 3 illustrates the two roller chains in conjunction with the toothed sprockets for driving the paper and also illustrates the means of cutting the knuckles off the pleats.
Figure 5:
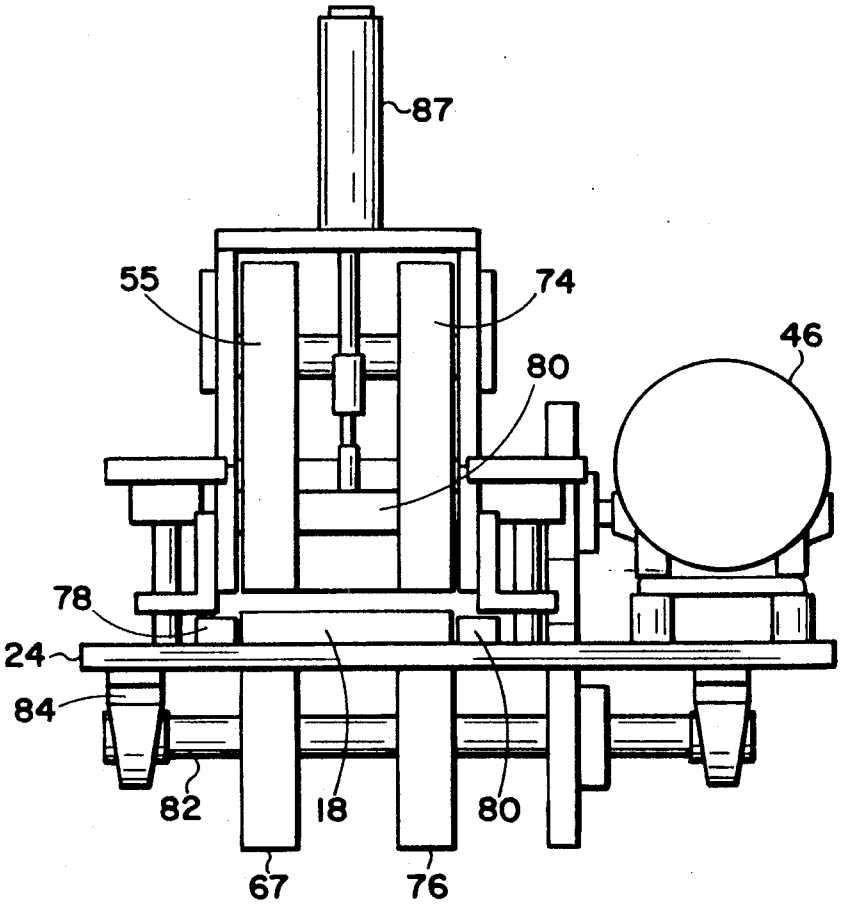
FIG. 5 is an end view showing the paper entrance of the packing cutter, gear box and servo motor.
Figure 4:
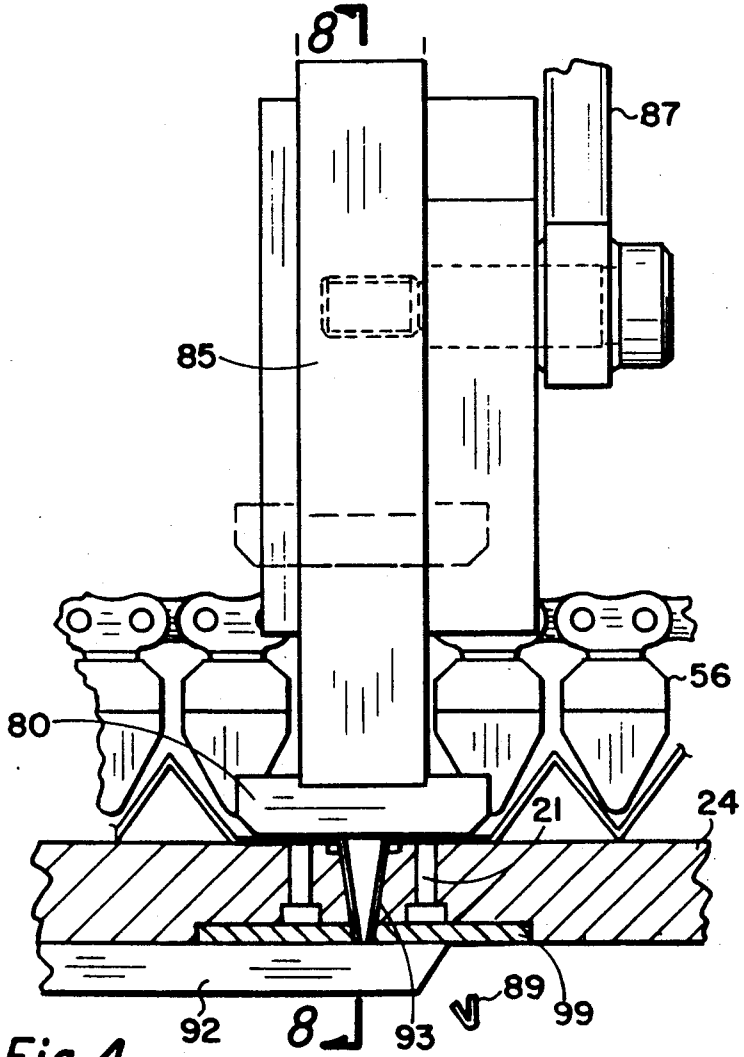
FIG. 4 illustrates that portion of FIG. 3 that is used to push the paper through the cutting slot into the path of the shearing blade.
Figure 8:
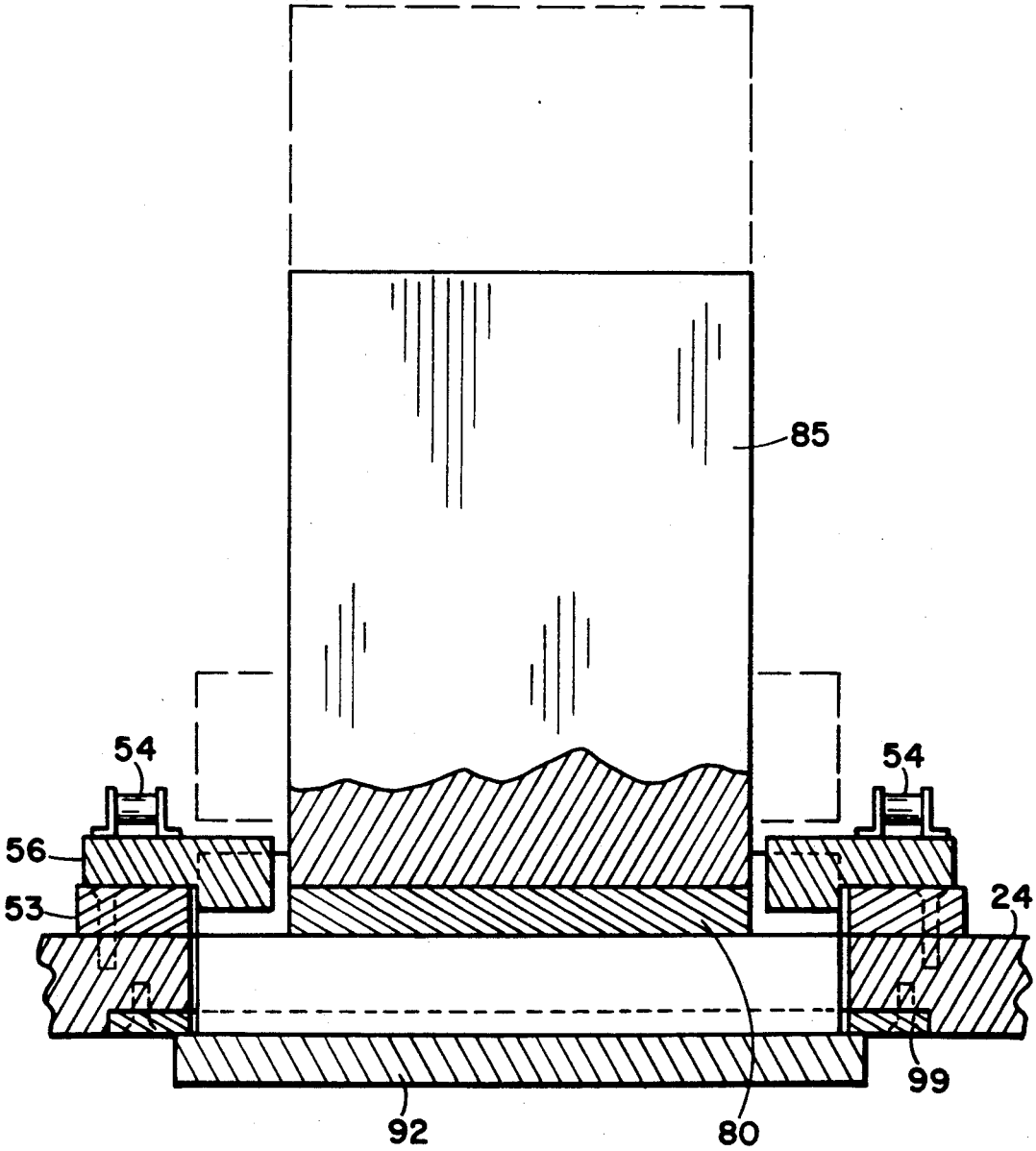
FIG. 8 is a simplified view taken along the line 8—8 of FIG. 4.

Attention is next directed to FIGS. 3 and 4 that show in greater detail cutter 20. Shown thereon is a toothed roller chain 54 that has teeth 56. The chain is held in triangular-like position by first roller 58, a drive roller 60 that is driven by drive gears 62 that, in turn, is driven by servo motor 46. A tension wheel 64 is provided so that proper tension can be applied to the drive chain. Rotation is in the direction of the arrows on the drawing. Teeth rail 52 is shown in FIG. 8. Mounted directly beneath roller 58 is a sprocket 66 that has teeth 68 thereon. The upper part of sprocket 66 extends through an opening or cut away portion 70 in plate 72. The teeth of sprocket 66 and of chain 54 are the same height as the depth of the pleats of the paper being processed and mesh with each other. The paper is held down as it comes out of oven 16 by a flat spring 22. The pleats are pulled by the teeth of roller chain 54 in cooperation with the teeth of sprocket 66. Plate 72 can be narrower where the teeth or sprockets 66 are located and wider where the cutter mechanism is. As can be seen in FIG. 5 there is a cover box 67 for sprocket 66 and cover plate 55 for link chain 54. There is also a parallel drive chain identical to chain 54 in cover box 74 and a parallel sprocket in cover plate 76. There is thus a toothed chain and mating together sprocket near each edge of the pleated paper. The paper 18 is held between side rails 78 and 80 that are used to hold the paper in the proper position so that it will be in proper position with respect to the paralleled toothed chains and paralleled toothed sprockets. As seen in FIG. 5, sprocket 66 is mounted on a shaft 82 that is supported by brackets 84 from plate 24.

The main propose of the apparatus is to clip off the knuckles, i.e., the top of each of valley of the pleated paper. The means to accomplish this will now describe in more detail. There is a paper pusher mechanism illustrated in FIGS. 4, 5, and 8 that includes a paper pusher 86 having a base 80 with slide mechanism 85 driven by air-cylinder 87. At the precise time that the next pleat is in position air pressure is applied to drive the mechanism down so that a pleat is driven through the V-shaped slot 93 in table 24. As soon as the pleat is driven down, knife 92 is driven by air-cylinder 96 that has extension rod 94, cuts off the tip or knuckle 89 of the pleat. Air-cylinder 96 (FIG. 3) is held by bracket 98 from the table top.

Attention is directed to FIG. 3 in particular to show switches for activating the paper pusher, the cutter and movement of chain 54. At each stop of the movement of chain 54, the computer signals air-cylinders 87 to drive the proper pusher down. There are two proximity switches 41 and 43 on the housing of the paper pusher. Proximity switch 43 generates a signal when the pusher is all the way down. At this point the knuckle of the pleat is ready to be cut. The signal from switch 43 is fed to a computer that activates air-cylinder 96 to drive knife 92 to clip off knuckle 89. A proximity switch 45 detects when knife 92 has made its cut. The signal from switch 45 is fed to the computer to signal air-cylinder 96 to retract the knife and signals air-cylinder 87 to lift the paper pusher. Proximity switch 47 has an output signal when knife 92 has returned to its starting position. Air can be blown upward through passageways 21 in the table top 24 to blow the pushed pleat back to its pleat position. The signal from proximity switch 41 can initiate this brief surge of air. A signal from proximity switch 41 indicates that the paper pusher is in the upper position. Signals from switches 41 and 47 are fed to the computer system that, upon receiving both, signals servo motor 46 to move chain 54 so that the next pleat will be moved into position to be clipped. The signals just described will then be repeated and this sequence will be continued until the desired number of pleats are clipped.

Figure 7:
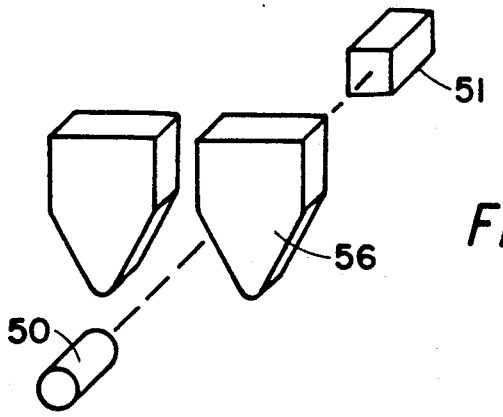
FIG. 7 illustrates the optical scanner to assure proper tooth position.

It is imperative that the machine stop at the precise point every time in regard to the pleats of the paper to ensure proper orientation for shearing the knuckles off the paper. This is accomplished by using an optical sensor, as illustrated in FIG. 7, that includes a light source 50 and a photodiode 51 that receives the light. The teeth are spaced a known distance apart and if the light source and diode are positioned on a perpendicular line half way between the two teeth, then a known amount of light will pass through. If this known amount of light is detected, then it is known that the teeth are in the proper orientation with respect to the cutting of the knuckles, thus no corrective action needs to be taken. However, if the chain stops and the knuckle cutter and paper pusher function and if the light is less than the amount known to pass through with proper alignment, then it is known that the teeth are not properly coordinated with the chain function. The optical sensors, in effect, measure the distance (window) between the teeth after each cycle. By each cycle is meant each cutting of a knuckle. If the window is off, i.e. the amount of light that is detected is less than the amount if the teeth are properly oriented, then a signal is sent to servo controller 40 (FIG. 2) that directs servo motor 46 to compensate for the accumulative error in the mechanical driver. This is used to check teeth position at each cycle of the pack cutter and ensure the proper position of the pleat over the spot in the table top. The optical scanner measures the amount of light that passes between the adjacent teeth. If some of the light is blocked then the teeth are not properly positioned. The amount of light indicates the distance, if any, that the teeth are out of position. If out of position, the computer causes servo motor 46 reposition itself for the next cycle. If the amount of light detected is less than the correct amount, then the movement of the chain will be advanced an amount indicated by the light detected to correct the misalignment. This step is necessary because of the accumulated tolerance in the chain.

The cycle rate typically is 30 cuts per minute or one every two seconds. Each pack, for example, has 59 pleats. This may be changed to meet customer requirements.

The general operation of the above embodiment will now be briefly described. A roll of paper 10 passes through a paper pleater 12 and through oven 16. The paper pleater 12 and oven 16 are continuous operations. What comes out of the oven is a partially dried pleated paper 18 that is held in position by flat spring 22. The teeth in chains 54 are such that the teeth mesh with the pleats and are the same height thereof. The teeth of sprocket 66 mesh with the teeth of the chain and as the chain rotates or is moved, the paper is pulled through the cutting device shown in FIG. 3. The servo motor 46 is controlled to stop each time a pleat advances over slit 93. At that same time the paper pusher pushes a pleat into slot 93 cutter blade 92 is actuated by air-cylinder 96 to cut off knuckle 89 as shown in FIG. 4. The paper pusher 86 immediately retracts and the servo motor immediately moves the teeth to the next cycle so that the next knuckle can be cut off the next pleat. As explained above, light source 26 and photodiode 28 assure that there is enough paper coming out of the oven so that it will not be stretched by the pulling mechanism in cutter 20. If there is not sufficient paper then the servo controller will be shut down until sufficient paper is available. It is also imperative that the teeth on the drive chains be aligned properly with slot 90 each time that the paper pushes a pleat to be cut. This synchronization is obtained by the use of an optical scanning system, as shown in FIG. 7. If the teeth block a part of the light, the servo machine will be adjusted to compensate for the movement required to properly align the teeth for the next cut. This automatically compensates for any accumulated error in the mechanical driver.

Further, knuckles of the valleys of pleated paper 18 are cut off one at a time automatically by a machine without the intervention of human help. It is also to be noted that the number of knuckles cut is counted and when the required number of cuts have been made then the machine shuts down and the cut pack can be removed. The machine can then be restarted. The number of pleats cut per pack will depend upon the customer or required number for the next step in the process equipment for making filters.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for shearing the knuckles of pleated paper which comprises:

a table with a slit;

two paralleled toothed roller chains supported along the top of the table; motor means to drive said chains;

two parallel tooth sprockets directly under the roller chains with teeth meshing with the teeth of the teeth of the chain so that when the chain is moved paper can be pulled;

means to push one pleat at a time through said slit; and knife means operable to cut off the knuckle of said pushed pleat.

2. An apparatus as defined in claim 1 including:

means to determine the amount of pleated paper readily available for roller chains to pull and to have an output signal indicative of the amount of paper available; and means to control the movement of said chain in response to said output signal.

3. An apparatus as defined in claim 1 including:

means to detect whether the teeth of a chain is in proper position when the knife means is operated and including means to modify the position of the teeth in response thereto.

4. An apparatus as defined in claim 2 including:

means to count the cuts and stop the motor means when a selected number of cuts has been made.

5. An apparatus as defined in claim 1 including:

at least one hole through said plate adjacent said slit for blowing air therethrough after each cut has been made.

6. An apparatus for shearing the knuckles off pleated paper which comprises:

a source of pleated paper from which a continuous source of pleated paper may be obtained;

a table with a slot therethrough and having a top on which the paper may ride;

a pair of parallel tooth roller chains above said table top with the teeth designed to fit into said pleats;

a tooth sprocket below each said chain and spaced so that the teeth of the chain and of the sprockets mesh and when moved pull the pleated paper;

a paper pusher for pushing a pleat of the paper through the slot upon the alignment of the pleat and the slot; and cutting means to cut the knuckle off the pleat when it is pushed through the slot.

7. An apparatus as defined in claim 6 including:

optical means to determine the relative position of the teeth with respect to said slot when the paper pusher pushes paper through said slot and to provide a control signal; and control means responsive to said control signal to correct the position of said teeth of said chain.

8. An apparatus for shearing the knuckles of pleated paper which comprises:

a source of pleated paper;

a table with a slot;

two paralleled toothed roller chains supported along the top of the table;

motor means to drive said chains;

two paralleled toothed sprockets directly under the roller chains with teeth meshing with the teeth of the teeth of the chain so that when the chain is moved, paper can be pulled;

means to push one pleat at a time through said slot, such means including a cylinder having a drive piston, a first proximity switch located on the upper part of said cylinder having an output signal when the cylinder piston is adjacent thereto;

a second lower proximity switch having an output signal when the piston reaches such switch;

knife means provided to cut off the knuckle of said pushed pleat;

an air-cylinder for driving said knife means;

a third proximity switch having an output signal when said knife means is in its retracted position;

a fourth proximity switch having an output signal when said knife means is in its extended position;

means to actuate said knife means when the signal is emitted from said second proximity switch;

means to drive said pusher upwardly when there is a signal on said fourth proximity switch;

means to move said servo motor to drive said chain a distance of one pleat when the computer receives signals from said first and third proximity switches and;

the signal from said fourth proximity switch initiates (a) retraction of the air-cylinder for driving the cutter and (b) initiates lifting the paper pusher.

* * * * *